US006692192B2

(12) United States Patent
Poldervaart

(10) Patent No.: US 6,692,192 B2
(45) Date of Patent: Feb. 17, 2004

(54) SPREAD MOORED MIDSHIP HYDROCARBON LOADING AND OFFLOADING SYSTEM

(75) Inventor: Leendert Poldervaart, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/137,482

(22) Filed: May 3, 2002

(65) Prior Publication Data

US 2003/0206771 A1 Nov. 6, 2003

(51) Int. Cl.[7] ..... B63B 21/50
(52) U.S. Cl. ..... 405/224; 114/293
(58) Field of Search ..... 405/195.1, 224; 114/293, 230.1, 230.2

(56) References Cited

U.S. PATENT DOCUMENTS 3,913,157 A * 10/1975 Versluis et al. ..... 441/5
4,826,354 A * 5/1989 Adorjan ..... 405/158
5,678,503 A * 10/1997 Poranski, Sr. ..... 114/230.2
6,494,271 B2 * 12/2002 Wilson ..... 114/230.1

FOREIGN PATENT DOCUMENTS

WO WO 01/10707 A1 * 2/2001

OTHER PUBLICATIONS

INTEC Engineering, Cabot Port Dickson CBM Terminal Project, Dec. 1998.*
SBM–IMODCO, Inc., News Roundup, vol. 1, Oct. 2001.*
VRYHOF, Anchor Manual 2000—The Digital Version, Third Edition, 2000.*

* cited by examiner

*Primary Examiner*—Robert E. Pezzuto
*Assistant Examiner*—Tara L. Mayo
(74) *Attorney, Agent, or Firm*—Young & Thompson

(57) ABSTRACT

Hydrocarbon mooring and transfer system includes a tower resting on the seabed, a vessel containing hydrocarbons, anchoring elements having at least four spaced-apart anchoring members connected via a respective anchor line to the vessel. A hydrocarbon transfer duct extends between a coupling position, located between the bow and stern of the vessel and the tower. The system includes at least six anchoring members, at least four of which are connected to the vessel, the vessel being attachable to at least two different groups consisting of four anchoring members in at least two orientations.

10 Claims, 3 Drawing Sheets

SPREAD MOORED MIDSHIP HYDROCARBON LOADING AND OFFLOADING SYSTEM

FIELD OF THE INVENTION

The invention relates to a hydrocarbon mooring and transfer system comprising a tower resting on the seabed, a vessel containing hydrocarbons, anchoring means comprising at least four spaced-apart anchoring members connected via a respective anchor line to the vessel, a hydrocarbon transfer duct extending between a coupling position, located between the bow and stern of the vessel, and the tower.

BACKGROUND OF THE INVENTION

Such spread moored hydrocarbon transfer systems are known in the prior art, in particular for oil loading and or offloading to a tower.

Furthermore, from U.S. Pat. No. 4,826,354 an LNG pipeline system is known in which LNG is offloaded from a tanker to an offshore tower resting on the seabed and is transported to shore via a pipeline utilising expansion joints to compensate for contraction. Generally, LNG will be offloaded from the tanker to an onshore storage tank whereas vapour from the storage tank are recirculated to the vessel to keep the tanks under pressure. From the onshore storage, the LNG may be fed to a regasification plant and forwarded to the network.

The known mooring configurations for midship offloading have as a disadvantage that under specific directions of winds and currents, it will not be possible to load or offload at the tower. This could be compensated by providing a rotating transfer duct at the tower having a 360° pipe swivel and dynamic positioning of the tanker vessel around the tower, which is however a costly solution.

An other option to moor an LNG carrier to an LNG offloading terminal comprising a loading crane is via a transfer connection at the stern of the vessel, anchorlines extending to several buoys from the bow and from the stern of the vessel in a spread moored configuration. The anchorlines at the bow of the vessel can be tensioned or slackened in such a way that the vessel can assume different positions depending on wind and current directions by fishtailing around the stem LNG transfer point. This system is described in Offshore Technology Conference 1825, 1973. In this mooring configuration, the transfer duct on the loading and offloading crane must follow the movements of the stern of the vessel, which are relatively large in view of the distance of the stern from the centre of the vessel and the limited fishtailing effect of a moored tanker.

OBJECT OF THE INVENTION

It is therefore an object of the present invention to provide for a loading and offloading system, which can handle tankers having a midship loading and offloading facility.

It is a further object of the present invention to provide for a flexible mooring system in which the vessel can be moored in several orientations depending on wind and current, the transfer duct during loading and/or offloading remaining substantially in a stationary position.

It is again a further object of the present invention to provide for a relatively simple and cost effective mooring system which is particularly suitable for safe and stable loading and offloading of cryogenic fluids, such as LNG or LPG from a vessel to shore.

SUMMARY OF THE INVENTION

Hereto, the hydrocarbon mooring transfer system of the present invention is characterised in that the system comprises at least six anchoring members, at least four of which are connected to the vessel, the vessel being attachable to at least two different groups consisting of four anchoring members in at least two orientations.

By providing a number of anchoring points around the tower, each anchoring point comprising for instance one or more piles in combination with a polyester mooring line, one or more pivoting piles or a buoy, the tanker can be spread moored by attaching it to at least four buoys in different orientations, depending on wind and current directions, without it being necessary for the tower to have a fully weathervaning hydrocarbon transfer swivel. Such a selectively main orientation of the vessel can guarantee a stable positioning during the time in which the vessel is moored to the tower, which for an offloading operation may be for instance 20 hours for vessel position adjustment, connection of the mooring lines, connection of the hydrocarbon transfer arms, cooling down of the transfer duct, start-up of transfer, finishing and cleaning the transfer duct, disconnection of the transfer arms, mooring lines and takeoff off of the vessel.

Preferably, a number of eight mooring buoys are used, such that the vessel can be moored in four orientations forming an rectangular pattern around the tower, while loading or offloading from a midship position.

In a preferred embodiment, the vessel comprises a liquefied gas tanker, such as an LNG or LPG tanker. The offloaded LNG storage can be placed on shore but also offshore on a buoy including a regasification plant.

The vessel of the present invention can be a tanker vessel or a combined LNG storage and regasification plant. The vessel can be spread moored in a relatively stiff manner, but can also be provided with weathervaning capacities relative to the tower by employing a spread mooring system such as described in WO 01/10707 and WO 00/78600, in the name of the applicant.

BRIEF DESCRIPTION OF THE DRAWINGS

The invention will be described in detail with reference to the accompanying drawing. In the drawing.

DETAILED DESCRIPTION OF THE INVENTION

Figure 1:
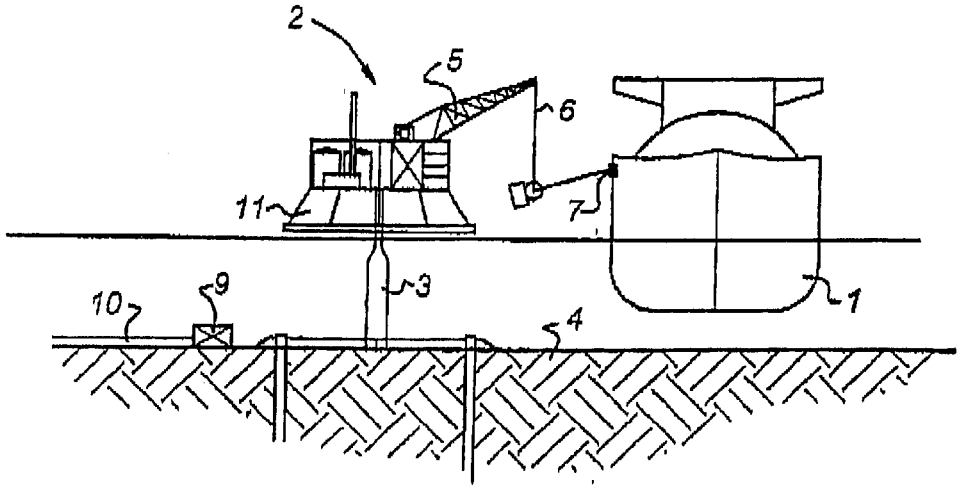
FIG. 1 shows a side view of an LNG offloading system according to the present invention.

FIG. 1 shows an LNG shuttle tanker 1 which is moored in a spread moored configuration alongside an LNG offloading terminal 2 comprising a tower 3 resting on the seabed 4. The tower 3 comprises an arm support structure 5 from which an articulated LNG transfer duct 6 is suspended. The LNG transfer duct 6 can be of the type such as described in WO 99/50173, in the name of the applicant. The cryogenic transfer duct 6 connects to a midship coupling 7 on the tanker vessel 1 for offloading of the tanks 8. Via the tower 3, the LNG is supplied through a manifold 9 to shore through multiple pipelines 10.

The tower 3 is protected by a ring fender 11, which prevents the vessel 1 from contacting the tower 3.

Figure 2:
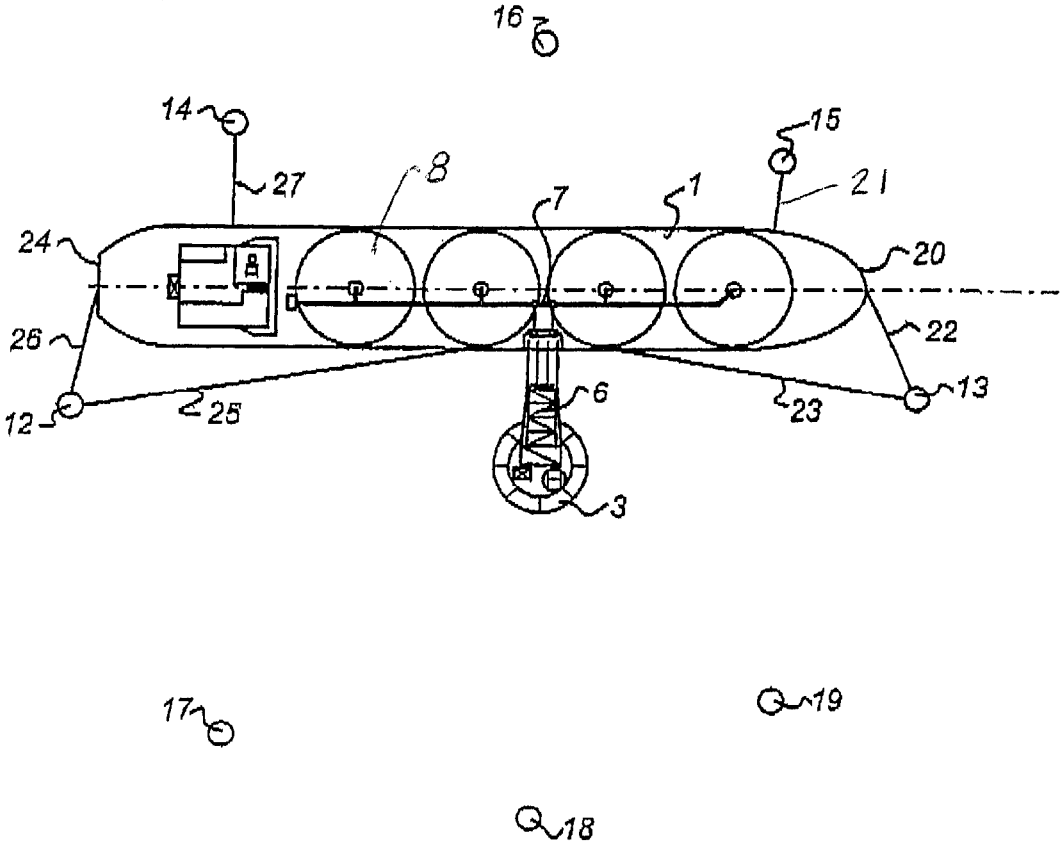
FIG. 2 shows a top view of the mooring and transfer system of FIG. 1.

FIG. 2 shows a top view of the tanker 1, moored to four buoys 12, 13, 14 and 15 and attached to the duct 6 near midship position. The bow 20 of the vessel 1 is attached to buoys 13 and 15 via three anchorlines, including breasting lines, 21, 22 and spring line 23. The stern 24 of the vessel 1 is maintained in a stable and stationary position by being connected to buoys 12 and 14 via three anchorlines, including breasting lines, 26 and 27 and spring line 25. The vessel can be moored in an orientation perpendicular to the one shown in FIG. 2 by connecting anchor lines 23 and 25 to buoy 16 and 18 respectively and anchor lines 21 and 27 to buoys 14 and 17, or by connecting anchor lines 23 and 25 to buoys 18 and 16 respectively and anchor lines 21 and 27 to buoys 19 and 15 respectively. A parallel configuration to the one shown in FIG. 2 is obtained by rotating the shuttle tanker 1 by 180° and connecting anchor lines 21 and 27 to buoys 17 and 19 respectively. In the mooring configuration shown in FIG. 2, there are no buoys in front or in the rear of the vessel such that free access to any of the mooring positions is warranted.

The tower 3 is provided with a rotating deck and manifold for rotation of the duct 6, which may be a plus or minus 180° rotation from the position shown in FIG. 2; but which need not be a fully 360° rotating arm.

Figure 3:
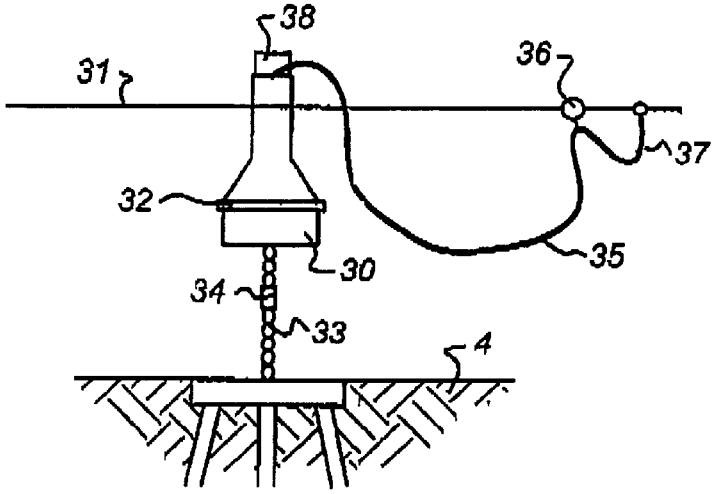
FIG. 3 shows an example of an anchoring buoy used in the mooring and transfer system of the present invention.

As is shown in FIG. 3, the buoys used are submerged anchorline buoys (SALM) 30 which float at sealevel 31 and which comprise a fender 32 for protecting the buoys against damage when impacting with a shuttle tanker 1 or tug installing the tanker in its mooring position. The buoy 30 is connected to the seabed through a chain 33, which comprises a chain swivel 34. The slender upper part of the buoy may have a diameter of 2 meters, whereas the broadened liner part may have a diameter of about 6 meters. A mooring hawser 35 is connected to the top of the buoy and comprises a floatation device 36 and pick-up line 37 for connecting it to the tanker 1. For the buoys 16, 17, 18 and 19 shown in FIG. 2 which are not connected to the vessel, the mooring hawser 35 will not be attached. Only the buoys that are used in the mooring configuration will be provided with mooring hawsers 35 when the vessel approaches the terminal. This prevents accidents with the mooring lines and reduces the risk of mooring lines entering in the propellers and will give the tugs more freedom of motion at the terminal for positioning of the tanker vessel. Hereto, a connector 38 is provided at the mooring line 35 for releasably engaging with the buoy 30. Alternatively, the mooring hawsers 35 of the buoys, which are not connected to the vessel in a particular anchoring configuration, are rolled up and connected on the respective buoy such that they do not freely float in the water.

Figure 4:
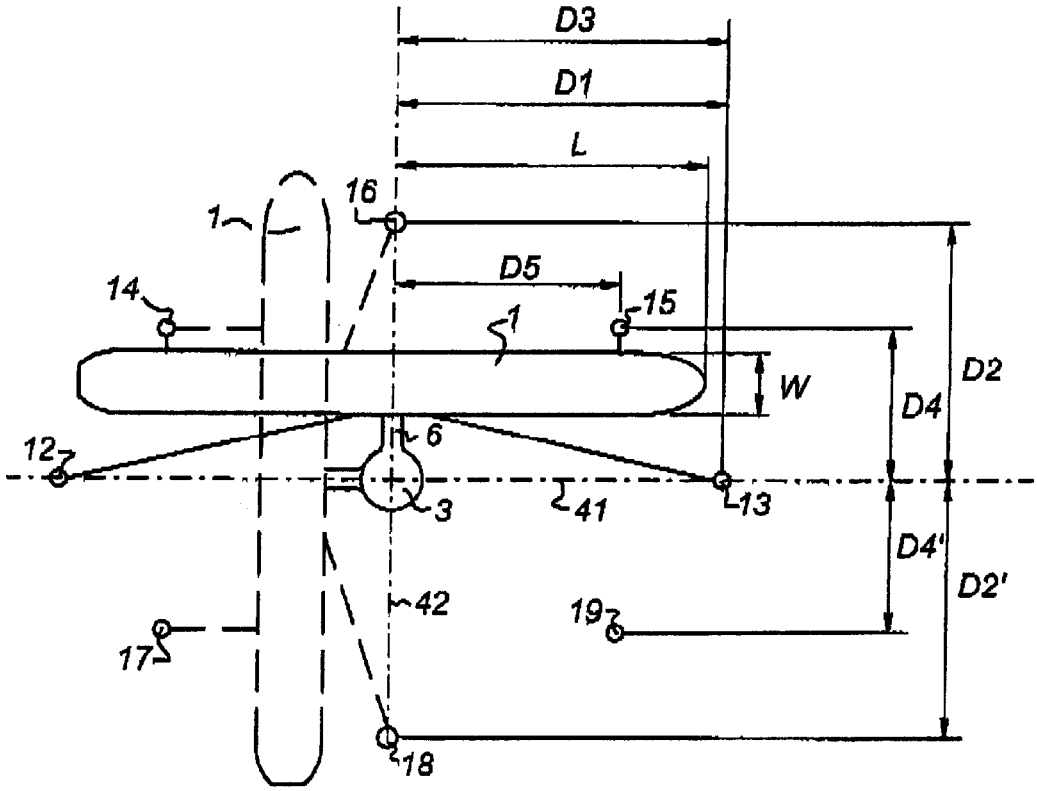
FIGS. 4 and 5 show different mooring configurations obtainable with the present system.

FIG. 4 shows two positions of the vessel 1 alongside the tower 3. With respect to a first axis 41 and second axis 42, that are perpendicular and intersect at the tower 3, the buoys 12 and 13 are located at or near the first axis 41. The distance 2D1 between buoys 12 and 13 may be 1–1.5 times the length 2L of the vessel 1. The buoys 14 and 15 may be located at a distance D4 from axis 41 which is larger than the width of the vessel W and combined width of tower 3 and transfer duct 6. Distance D4 may be for instance 30 meters. Distance D5 of buoy 15 from axis 42 may be for instance 100 meters. The length of the vessel 1 is for instance 250 rooters. Buoys 17, 18 and 19 are symmetrical with buoys 14, 15, 16 around the axis 41 and have corresponding distances D1 and D4 from the axis 41.

Figure 5:
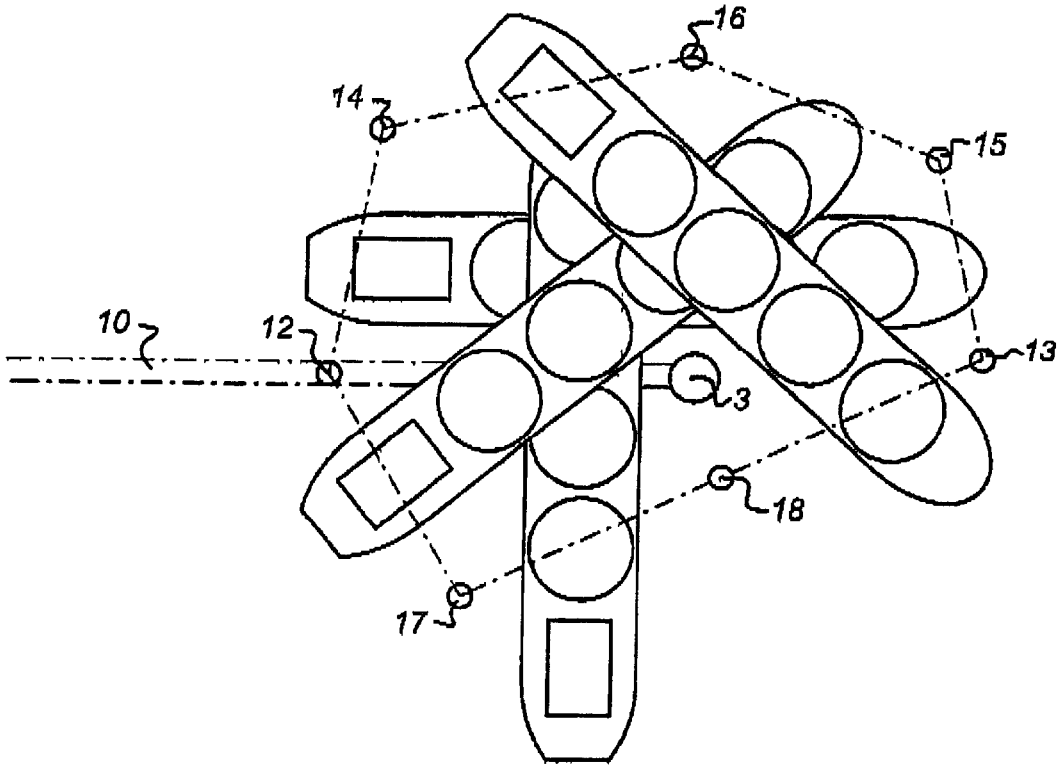

Finally, FIG. 5 shows possible mooring configurations around a tower 3 by using only seven buoys, allowing for different mooring positions. The number of mooring buoys in excess of four depends on the required number of positional variations and consequently on prevailing wind and weather conditions in this specific area of operation.

What is claimed is:

1. A hydrocarbon mooring and transfer system (2) comprising a tower (3) resting on the sea bed (4), a vessel (1) containing hydrocarbons, anchoring means comprising at least six spaced-apart anchoring members (12, 13, 14, 15, 16, 17, 18, 19) at least four of which are connected via a respective anchor line (21, 22, 23, 25, 26) to a respective connection point on the vessel, the mooring and transfer system having at least two anchoring orientations, a hydrocarbon transfer duct (6) extending in each orientation between the coupling position (7), located between the bow (20) and the stern (24) of the vessel and the tower (3), wherein in the first orientation of the vessel (1) the connection points are attached to a first group of anchoring members (12, 13, 14, 15) and wherein in the second orientation of the vessel (1) the connection points are each attached to a different anchoring member of a second group of anchoring members (14, 17, 16, 18), at least two anchoring members in the second group being different from the anchoring members in the first group.

2. The hydrocarbon mooring and transfer system (2) according to claim 1, wherein, when considering a first (41) and second axis (42), the axes being perpendicular and having a point of intersection at or near the tower (3), a first and second anchoring member (12, 13) are located on or near the first axis (41) at a mutual distance (2D1) corresponding to at least two/third of the length (2L) of the vessel (1) on respective sides of the second axis (42), a third and fourth anchoring members (14, 15) being placed at a mutual distance (2D5) corresponding to at least one/third of the length (L) of the vessel (1) on respective sides of the second axis (42), at a perpendicular distance (D4) from the first axis (41) that is larger than the combined width (W) of the vessel and length of the duct (6), a fifth anchoring member (16) being placed on or near the second axis (42) on the same side of the first axis (41) as the third and fourth anchoring members (14, 15), further away from the first axis (41) than the third and fourth anchoring members (14, 15), and a sixth anchoring member (17) being placed on a side of the first axis (41) opposite to the side of the third and fourth anchoring members (14, 15) at a perpendicular distance (D4') from the first axis (41) that is larger than the combined width (W) of the vessel and length of the duct (6), the position of the sixth anchoring member (17) along the first axis (41) being located between the tower (3) and the first anchoring member (12).

3. The hydrocarbon mooring and transfer system (2) according to claim 1, wherein a seventh anchoring member (18) is located at or near the second axis (42), on the side of the first axis (41) opposite to the side of the third and fourth anchoring members (14, 15), at a position (D2') further away from the first axis (41) than the sixth anchoring member (17), and an eighth anchoring member (19), located on the side of the first axis (41) opposite to the third and fourth anchoring members (14, 15), the position of the eighth anchoring member (19) along the first axis (41) being located between the seventh and the second anchoring members (18, 13).

4. The hydrocarbon mooring and transfer system (2) according to claim 1, wherein the distance (2D1) between the first and second anchoring members (12, 13) along the first axis (41) is larger than the length (2L) of the vessel, the distance (2D5) between the third and fourth anchoring members (14, 15) along the first axis (41) being smaller than the length (2L) of the vessel, the distance (2D5) between the sixth and eighth anchoring members (17, 19) along the first axis (41) substantially corresponding to the distance (2D5) between the third and fourth anchoring members (14, 15), the distance (2D2) between the fifth and seventh anchoring members (16, 18) along the second axis (42) substantially corresponding to the distance (2D1) between the first and second anchoring members (12, 13) along the first axis (41).

5. The hydrocarbon mooring and transfer system (2) according to claim 1, wherein the vessel (1) comprises a liquefied gas tanker, the transfer duct (6) comprising a cryogenic transfer duct.

6. The hydrocarbon mooring and transfer system (2) according to claim 1, the transfer duct (6) being connected to the tower (3) via a support structure (51) that is rotatable around a vertical axis by less than 360 degrees.

7. The hydrocarbon mooring and transfer system (2) according to claim 1, each anchoring member comprising a buoy (30).

8. The hydrocarbon mooring and transfer system (2) according to claim 1, the anchoring members (12, 13, 14, 15, 16, 17, 18, 19) each having a detachable anchor line connector (35, 36, 37, 38).

9. The hydrocarbon mooring and transfer system (2) according to claim 8, the anchor line connector comprising an anchor line (35) attached to an anchoring member (30) having a float (36) at one free end, the anchoring member (30) being placed at or near the sea surface, wherein the anchoring members in the system that are not attached to the vessel having no anchor line attached thereto.

10. The hydrocarbon mooring and transfer system (2) according to claim 1, the vessel (1) being attached to the anchoring members in a non-rigid manner to be able to weathervane through small angles.

* * * * *